United States Patent [19]

Chattman

[11] Patent Number: 4,903,848

[45] Date of Patent: Feb. 27, 1990

[54] MOUTHWASH PACKAGING

[76] Inventor: Ronald L. Chattman, Lakeside Apartments, Unit 2A, Millburn, N.J. 07041

[21] Appl. No.: 224,164

[22] Filed: Jul. 26, 1988

[51] Int. Cl.[4] ..... B65D 69/00

[52] U.S. Cl. ..... 215/227; 15/257 R; 15/145; 215/100 R; 220/85 D

[58] Field of Search ..... 215/227, 100 R, DIG. 5; 220/85 D; 15/145, 257 R; 206/217; 248/113; 132/308, 310, 313

[56] References Cited

U.S. PATENT DOCUMENTS

| | | | |
|---|---|---|---|
| 390,089 | 9/1888 | McClelland | 220/85 D UX |
| 700,653 | 5/1902 | Jobson | 220/85 D UX |
| 1,643,661 | 9/1927 | Kendall | 220/85 D UX |
| 2,177,504 | 10/1939 | Thompson | 215/227 X |
| 2,744,649 | 5/1956 | Smith | 215/100 R |
| 2,970,720 | 2/1961 | Dooley | 220/85 D |
| 4,232,785 | 11/1980 | Lucas | 215/100 R X |

FOREIGN PATENT DOCUMENTS

| | | | |
|---|---|---|---|
| 1087491 | 8/1954 | France | 215/DIG. 5 |

*Primary Examiner*—Donald F. Norton

*Attorney, Agent, or Firm*—Robert M. Skolnik

[57] ABSTRACT

A brush has a hole formed at the end of its handle. The hole cooperates with flexible prongs which interfit within the hole to removably engage and support the brush. The flexible prongs are attached to a combined bottle cap/cup which is utilized in combination with a liquid bottle. The cap/cup interfits over the mouth of the bottle in any of the usual ways as by threaded or frictional engagement with the mouth. The cup/cap may be formed in the shape of an ellipse so that it can also serve as an enlarged handle for the brush in that the brush is used without removing same from the cap/cup. In another embodiment, the cup/cap takes the form of an attachment which overfits a bottle and cap so that it can be employed as an attachment to existing packages without the necessity of modifying the existing packaging design and structure. The brush is attached to an overlay of an elongated shape of a size such that the brush hangs along the sides of the bottle.

6 Claims, 2 Drawing Sheets

FIG. 2
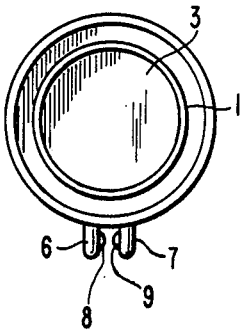
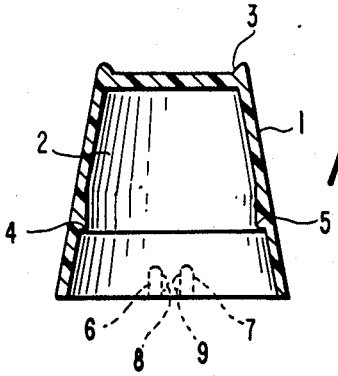
FIG. 1
FIG. 3
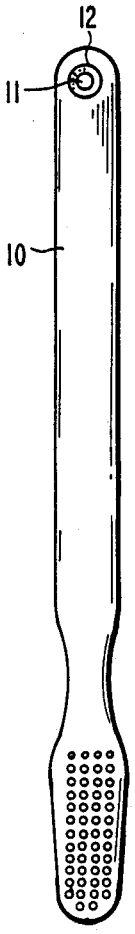
FIG. 4
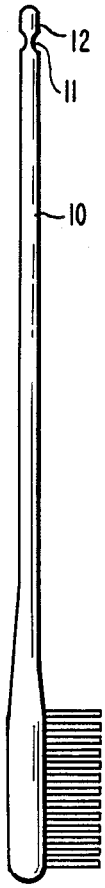
FIG. 6
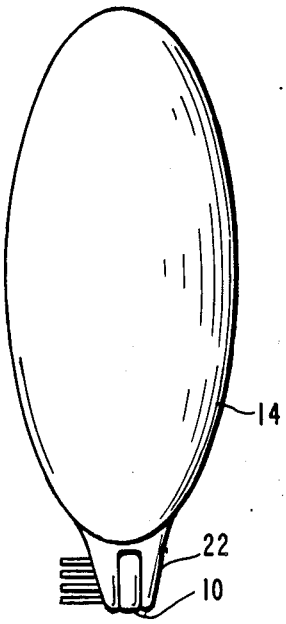

MOUTHWASH PACKAGING

FIELD OF THE INVENTION

This invention relates a package for mouthwash or other liquids. The liquid is packaged in a bottle. The bottle's top is formed as a cup. A brush is removably attached to the bottle top. The cup and cap may be formed in a circular shape or in the shape of an ellipse so that the cup may also serve as a handle extension portion for the brush.

DESCRIPTION OF THE PRIOR ART

Barker U.S. Pat. No. 971,818 and Cook U.S. Pat. No. 2,585,299 teach devices for supporting toothpaste tubes and toothpowder containers and for mechanically enabling the contents to become discharged from the tube. A rack for holding toothbrushes is coupled to the device. The device is mounted on a holder which is attached to the wall of the bathroom.

Warne U.S. Pat. No. 2,543,427 discloses a combined medicine bottle cap and measuring cup.

Cerniglia U.S. Pat. No. 2,545,135 and Merendino U.S. Pat. No. 2,956,851 show carousel holders for a plurality of toothbrushes which incorporate an indentation for supporting a drinking cup on the holder.

Other patents disclose combined sealing caps and drinking cups for bottles, flasks and picnic jugs include Brown U.S. Pat. No. 2,655,255; Saw U.S. Pat. No. 3,159,298; Collins U.S. Pat. No. 4,150,761; Swarwtout U.S. Pat. No. 4,416,381 and Selz U.S. Pat. No. 4,693,410.

Bottle caps with built-in applicator brushes for glue or nailpolish such as shown in Flynn U.S. Pat. No. 2,803,028 are also known.

SUMMARY OF THE INVENTION

The present invention uses a toothbrush or other brush which has a hole or other aperture formed near the end of its handle. The aperture cooperates with flexible prongs which interfit within the hole to removably engage and support the toothbrush. The flexible prongs are attached to a combined bottle cap/cup which is utilized in combination with a mouthwash bottle or other container. The cap/cup interfits over the mouth of the bottle in any of the usual ways as by threaded or frictional engagement with the mouth. The cup/cap may be formed in the shape of an ellipse so that it can also serve as an enlarged handle for the toothbrush in that the toothbrush is used without removing same from the cap/cup.

In another embodiment, the cup/cap takes the form of an attachment which overfits a bottle and cap. This embodiment enables the invention to be employed as an attachment to existing packages without the necessity of modifying the existing packaging design and structure. In this embodiment, the toothbrush is attached to an overlay of an elongated shape of a size such that the brush hangs along the sides of the bottle. A frictional, threaded or other engagement mechanism is employed to secure the overlay to the existing bottle cap.

The principal object of this invention is the provision of a combined toothbrush support and cup attachment for attachment to a mouthwash package. Another object of this invention is the combination of a toothbrush with a combined bottle cap and cup attachment which may additionally serve as a handle for use in combination with the toothbrush.

A still further object of the invention is the provision of a removable toothbrush for attachment to a mouthwash bottle. An additional object of the invention is the combination of an attachment for a mouthwash bottle which attachment includes a removable toothbrush and an elliptical shaped cup attachment which interfits over the bottle top.

Another object of the invention is the provision of attachment means on a bottle cap which incorporates prongs for engaging a hole in the handle of a toothbrush.

BRIEF DESCRIPTION OF THE DRAWINGS

These as well as further objects and advantages of the invention will become apparent to those skilled in the art from a review of the following detailed specification of my invention, reference being made to the accompanying drawings in which:

FIG. 1 is a side sectional view of the apparatus of my invention;

FIG. 2 is a top view of the cap/cup support of my invention;

FIG. 3 is a top view of the toothbrush used with my invention;

FIG. 4 is a side view of the toothbrush of FIG. 3; and

FIG. 6 is a top view of the modification of FIG. 5.

DETAILED DESCRIPTION OF THE INVENTION

Figure 5:
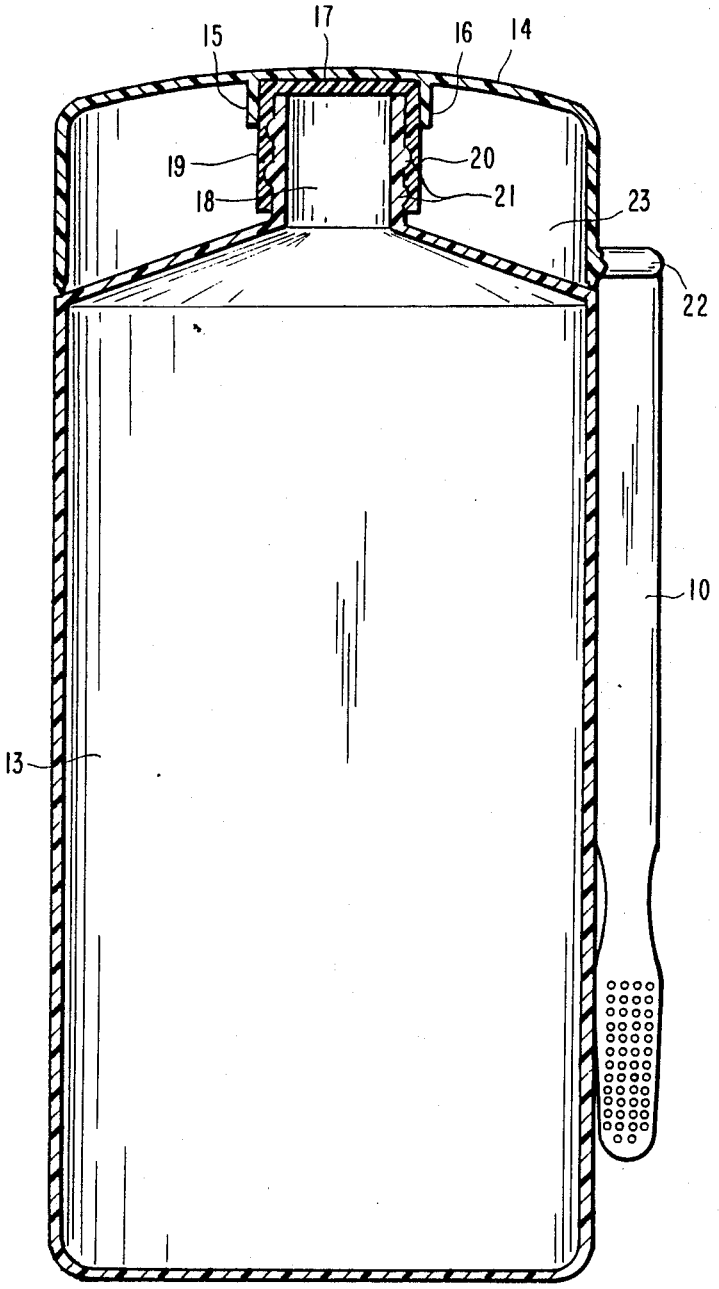
FIG. 5 is a side view of a bottle with a modification of my invention employed therein shown partially in section.

As shown in FIGS. 1 and 2, a circular shaped bottle cap 1 is provided with tapered side walls forming a cup 2 interiorly of the cap 1. Protrusions 4 and 5 on the interior side walls of the cup/cap 1 are illustrative of a type of frictional fit engagement mechanism where the protrusions or deformations 4 and 5 snap over the mouth of a bottle.

Also formed on the cap 1 are two prongs 6 and 7. The prong 6 has a nipple 8 formed centrally thereon and prong 7 has a nipple 9 formed centrally thereon. These nipples interfit with a hole 11 in the handle of a toothbrush 10 (FIGS. 3 and 4) and provide support for the toothbrush as it "hangs" from the cap 1 via prongs 6 and 7 and associated nipples 8 and 9.

FIG. 2 is a top view of the cup/cap 1 of FIG. 1. Numeral 3 in FIGS. 1 and 2 denotes a rim formed around the exterior top surface of the cup/cap 1. This rim provides a stabilizing support for the cup/cap when used in a cup mode and the cup is set onto a table or other surface.

FIGS. 3 and 4 are top and side views, respectively, of a toothbrush suitable for use with the support cap of FIGS. 1 and 2. The toothbrush 10 has a hole 11 formed in its handle. The hole 11 may be formed with a countersunk beveled surface 12 adjacent hole 11. While a hole 11 and bevel 12 is shown, it should be noted that a hole is simply one way of forming an aperture in the handle of the toothbrush which aperture cooperates with the nipples 8 and 9 to support the toothbrush. Other ways of forming such an impression in the handle of the toothbrush may be employed.

FIG. 5 is a side view of another embodiment of my invention. This embodiment is designed to overfit onto the existing bottle packaging without modification of such existing packaging. In this embodiment, a mouthwash or other bottle 13 is shown having the toothbrush 10 suspended against a side of the bottle. The brush 10 is suspended between prongs of which prong 22 is shown it being understood that prong 22 is identical in structure and function to prong 6 of FIGS. 1 and 2.

In this embodiment however, the prong 22 is attached to an attachment member 14, Member 14 engages onto bottle mouth 18 via bottle cap 17 having sidewalls 19 and 20. These sidewalls 19 and 20 screw threadedly engage the bottle mouth via threads 21. The attachment member 14 has protrusions 15 and 16 formed interiorly thereof to frictionally engage cap 17 and its sidewalls 19 and 20. The protrusions 15 and 16 may be formed of such depths that a cup is created therein. Alternatively, the cup may be formed by the entire interior portion 23 of the attachment 14.

The shape of cup/cap 1 and attachment 14 may be varied to suit specific bottle design, dimensions, configuration and shape. It has been found however, that for some persons, an elliptical shape as shown in FIG. 6, a top view of FIG. 5, permits the ellipse to be used as an extension of the handle of the toothbrush so that the toothbrush may be easier to use by grasping a portion of the toothbrush handle and the elliptical support.

As modifications to the foregoing may be made without departing from the spirit and scope of my invention, what is sought to be protected is set forth in the appended claims.

I claim:

1. A packaging apparatus for connecting a handle to a container comprising: bottle cap means for a container, said bottle cap means having interior surfaces thereof formed as a cup means for holding liquids, and exterior surfaces thereof formed in an elliptical shape to enable said cap means to be more easily grasped and to serve as an extension of said handle, said bottle cap means having support means attached thereto, said support means comprising a pair of extensions extending from said closure means; flexible protrusions attached to each of said extensions, said protrusions being located for cooperatively supporting a handle therebetween.

2. Apparatus for supporting a brush on a bottle of liquid, said apparatus comprising:

support means for overfitting onto a bottle, a pair of extensions extending from said support means; flexible protrusions attached to each of said extensions, said protrusions being located for cooperatively supporting a brush therebetween said support means including exterior surfaces thereon formed to enable said support means to serve as a handle for said brush.

3. The apparatus of claim 2 wherein said support means includes means for removably attaching said support means to said botle.

4. The apparatus of claims 1 or 2 further including brush means having a handle, means formed in said handle for cooperatively engaging and interfitting with said protrusions to support said brush means.

5. Apparatus for supporting a brush on a bottle of liquid comprising:

support means having liquid cup means formed therein; attachment means connected to said support means, said attachment means including flexible protrusions means extending from said support means for engaging and supporting said brush, said attachment meahs comprising a pair of extensions attached to an laterally extending from said support means, said flexible protrusion means being coupled to said extensions said support means including exterior surfaces thereon formed to enable said support means to serve as a handle for said brush.

6. The apparatus of claim 5 wherein said attachment means comprises a pair of extensions attached to and laterally extending from said support means, said flexible protrusions means being coupled to said extensions.

* * * * *